US012668400B2

(12) United States Patent
Simms, II

(10) Patent No.: US 12,668,400 B2
(45) Date of Patent: Jun. 30, 2026

(54) STACKABLE VENTED FOOD CONTAINER

(71) Applicant: Waddington North America, Inc., Chelmsford, MA (US)

(72) Inventor: Russell L. Simms, II, Cleveland, TN (US)

(73) Assignee: Waddington North America, Inc., Chelmsford, MA (US)

( * ) Notice: Subject to any disclaimer, the term of this patent is extended or adjusted under 35 U.S.C. 154(b) by 0 days.

(21) Appl. No.: 18/568,030

(22) PCT Filed: May 13, 2022

(86) PCT No.: PCT/US2022/029254

§ 371 (c)(1),
(2) Date: Dec. 7, 2023

(87) PCT Pub. No.: WO2022/260826

PCT Pub. Date: Dec. 15, 2022

(65) Prior Publication Data

US 2024/0270443 A1 Aug. 15, 2024

Related U.S. Application Data

(60) Provisional application No. 63/208,727, filed on Jun. 9, 2021.

(51) Int. Cl.
*B65D 21/02* (2006.01)
*B65D 1/34* (2006.01)
(Continued)

(52) U.S. Cl.
CPC ..... *B65D 21/0222* (2013.01); *B65D 1/34* (2013.01); *B65D 43/0212* (2013.01);
(Continued)

(58) Field of Classification Search
CPC .. B65D 21/0222; B65D 1/34; B65D 43/0212; B65D 51/1622; B65D 2543/00092;
(Continued)

(56) References Cited

U.S. PATENT DOCUMENTS 4,561,562 A 12/1985 Trombly
4,844,263 A 7/1989 Hadtke
(Continued)

FOREIGN PATENT DOCUMENTS

EP 3433185 B1 5/2020
GB 881225 A * 11/1961 ..... B65D 43/0212
(Continued)

OTHER PUBLICATIONS

International Search Report and Written Opinion, International Application No. PCT/US2022/029254, dated Aug. 26 2022, 11 pages.
(Continued)

*Primary Examiner* — Nathan J Jenness
*Assistant Examiner* — Eric C Baldrighi
(74) *Attorney, Agent, or Firm* — Nelson Mullins Riley & Scarborough LLP

(57) ABSTRACT

A container suitable for hot foods includes a base having a wall that is slanted or curved outward from its bottom, and a lid having a rim attachable to the base, an intermediate region that rises upward, and an inner region that does not rise as high, such that when an identical container is stacked thereupon, the upper base is entirely supported by the lower lid intermediate region, forming a gap space between the lower lid inner region and the upper base. One or more ventilation holes in the lid inner region, together with channels in the base wall and/or intermediate region, allow vapor from the lower container to escape from the stack through the ventilation holes, gap space, and channels. The
(Continued)

intermediate region can be shaped to support an upper container mainly by compressive forces, further enhancing stacking tolerance to weight and heat.

13 Claims, 14 Drawing Sheets

(51) Int. Cl.
*B65D 43/02* (2006.01)
*B65D 51/16* (2006.01)

(52) U.S. Cl.
CPC ..... *B65D 51/1622* (2013.01); *B65D 2543/00092* (2013.01); *B65D 2543/00296* (2013.01); *B65D 2543/00351* (2013.01); *B65D 2543/00527* (2013.01); *B65D 2543/00537* (2013.01); *B65D 2543/00657* (2013.01); *B65D 2543/00685* (2013.01); *B65D 2543/00768* (2013.01); *B65D 2543/00796* (2013.01)

(58) Field of Classification Search
CPC ..... B65D 2543/00296; B65D 2543/00351; B65D 2543/00527; B65D 2543/00537; B65D 2543/00657; B65D 2543/00685; B65D 2543/00768; B65D 2543/00796; B65D 2205/02; B65D 21/022; B65D 21/0219
USPC ..... 206/508
See application file for complete search history.

(56) References Cited

U.S. PATENT DOCUMENTS

| | | | | |
|---|---|---|---|---|
| 11,794,972 | B2 | 10/2023 | Vish | |
| 2003/0062365 | A1 | 4/2003 | Krueger | |
| 2008/0000795 | A1 | 1/2008 | Deakin et al. | |
| 2012/0141637 | A1 | 6/2012 | Mooney et al. | |
| 2012/0152957 | A1* | 6/2012 | Smith | B65D 55/02 70/160 |
| 2017/0247141 | A1 | 8/2017 | Gosen et al. | |
| 2024/0010406 | A1 | 1/2024 | Vish | |

FOREIGN PATENT DOCUMENTS

| | | | |
|---|---|---|---|
| KR | 20070107712 | A | 11/2007 |
| WO | 2022/260826 | A1 | 12/2022 |

OTHER PUBLICATIONS

Extended European Search Report and Opinion from European Patent Application No. 22820752.8, issued Apr. 10, 2025, all enclosed pages cited.

* cited by examiner

STACKABLE VENTED FOOD CONTAINER

CROSS-REFERENCE TO RELATED APPLICATIONS

This application is a 35 U.S.C. 371 national stage filing of International Application PCT/US2022/029254, filed May 13, 2022, which claims priority from U.S. Provisional Patent Application No. 63/208,727, filed Jun. 9, 2021, the entire contents of which are incorporated herein by reference.

FIELD OF THE INVENTION

The invention relates to plastic food containers, and more particularly, to stackable plastic food containers.

BACKGROUND OF THE INVENTION

A large variety of plastic food containers are used extensively by caterers, institutional food providers, restaurant take-away food providers, as well as in-person dining restaurants, grocery delis, and prepared food bars, among others. Generally speaking, plastic food containers are used by these industries and others to contain food items while they are being transported from a preparation location to a consumption location. As such, plastic food containers typically comprise a plastic base, which might be a tray, bowl, or basin, and a plastic lid, which might be domed or flat, that is securely attachable to the base and configured to minimize any spillage of food content from the container during transit. Often, plastic food containers are designed to be stackable, so that several containers that are similar or identical to each other can be securely stacked on top of one another for stocking and display purposes and to allow multiple containers to be safely carried all at once.

Food containers that are intended for transporting of hot foods, such as hot soups, face special challenges. Unlike relatively cooler foods, hot soups and other hot foods often require ventilation while they are within the container, so as to reduce the tendency for steam rising from the hot food to condense on the inner surface of the lid and fall back onto the food. The resulting build-up of pressure within the container can cause the lid to become detached from the base. Also, for many types of hot food, condensed moisture can cause the food to become soggy. Accordingly, it is often desirable to provide at least one opening in the lid of a hot food container so as to ventilate the contents.

One approach is to locate the ventilation opening or openings on the top of the lid, so that moderate tipping or shaking of the container will be less likely to cause hot soup, sauce, etc. to spill out through the ventilation openings. However, stacking of such containers can lead to blocking of the ventilation openings for all but the top container in the stack.

Another approach is to provide one or more ventilation openings in the side of the lid where they will not be blocked by stacking. However, this approach leads to increased risk that hot soup, sauce, or some other food component might splash through the side ventilation openings due to moderate tipping or shaking of the container. Additionally, it has been noted that venting on the sides of a container or lid is not nearly as effective as venting through the top of a container or lid, as steam and heat rise generally straight up and do not flow at an angle.

Another challenge that is faced by hot food containers is the ability of the plastic to withstand the heat of the food contents. Generally, the plastic base is made from a plastic that can withstand the heat of the food contents without softening or deforming, and is shaped as a bowl or basin, so that the hot food makes direct contact only with the base. This approach allows the lid to be made from a thinner and/or more cost-effective plastic that may not have a high tolerance to heat, under the assumption that the lid will not be required to withstand direct thermal contact with the food.

However, when two such containers are stacked on top of each other, the warm and heavy bowl or basin of the upper container is brought into direct contact with the lid of the lower container. The heat and force that are thereby applied by the bowl of the upper container can lead to unacceptable softening and/or sagging of the lid of the lower container, and in some cases can lead to a toppling of a stack of containers. This problem is exacerbated when more than two similar containers are included in a stack, because the weight that is applied to the lid of the bottom container is increased even further.

One approach is to make the lid out of a plastic that can withstand the heat of the food, possibly the same plastic as is used for the base. However, this approach will likely increase the cost of the container. Furthermore, if it is desired that the lid be transparent, so that the contents can easily be viewed while inside of the container, then it may be difficult to select a plastic that will withstand heat while at the same time providing high transparency.

What is needed, therefore, is a hot food container that is stackable, ventilated, spill-resistant, and resistant to softening and sagging of the lid when exposed to direct contact with the base of an adjacent stacked container that is filled with hot, heavy food.

SUMMARY OF THE INVENTION

The present invention is a hot food container that is resistant to softening and sagging of the lid when in direct contact with the base of an adjacent stacked container that is filled with hot, heavy food. In embodiments, the container is stackable, ventilated, and spill-resistant.

The base of the disclosed container includes a bottom and at least one surrounding wall arranged so that hot food contents placed within the container will make direct contact only with the plastic of the base. The surrounding wall is slanted or curved outward, such that an upper rim of the base extends horizontally outward beyond the bottom. It will be understood that the base can be round (i.e. a bowl), rectangular, or any other desired shape, so long as the upper rim is consistently larger in "diameter" as compared with the bottom, in that a line projected directly downward from any point along the upper rim will always fall outside of the bottom.

The lid of the disclosed container includes at least three concentric regions. An outer region or "rim" of the lid is configured for direct attachment to the upper rim of the base. An intermediate region of the lid is raised above the outer region, and is shaped so as to support the base of an adjacent, stacked compatible or identical container. An inner region of the lid does not rise as high as the intermediate region. This arrangement creates a gap space between the base of an upper stacked container and the central region of the lid of the lower stacked container, which assures that the base of the upper container will not directly block the ventilation openings of the lid of the lower stacked container.

Because the base of the upper container in a stack is supported entirely by the intermediate region of the underlying lid, the only contact between the base and the lid is in the intermediate region of the lid, which is proximate the outer region of the lid. As such, the forces applied to the lid of the lower container by the base of the upper container are primarily compressive forces, and not bending forces, whereby deformation of the plastic of the lid by the hot base is minimized, even if the upper container is filled with a heavy, hot food item and the lid of the lower container is made from a plastic that is thinner and/or more sensitive to flexing from heat than the plastic of the base.

In various embodiments, contact between an upper base and a lower supporting lid is limited to an apex ridge of the intermediate region. In some of these embodiments, the apex ridge is either proximate the boundary with the outer region, or connected to the boundary with the outer region by a curved, arch-like surface, thereby ensuring that most of the gravitational force that is applied to the lid by the upper container will be applied to the lid of the lower container as a compressive force and not a bending force.

In other embodiments, the intermediate region of the lid includes a concave or chamfered portion, which can extend from an apex ridge of the intermediate region inward to the boundary between the intermediate region and the inner region. The concave or chamfered portion can be shaped so as to complement a shape of the base, so that most or all of the concave or chamfered portion makes direct contact with the base of an adjacent upper container in a stack, thereby providing stable support.

In embodiments, the bottom of the base extends downward toward the central region of an underlying lid in a stack, thereby providing additional stability to a stack of the containers. An outer boundary of the downward-extending region can be proximate an inner boundary of the intermediate region of the underlying lid. The gap space is maintained, because the downward extending region of the base does not descend far enough to make contact with the central region of the underlying lid, and the channels that are provided in the base and/or the lid ensure that vented hot air and steam are able to escape from the gap space through vent passages. Similar embodiments include an upward extending base portion and corresponding upward extending portion of the central region of the lid, thereby providing additional stability to a stack of the containers.

In some embodiments of the present invention, the intermediate region includes at least one ventilation opening, and at least one channel is formed in at least one of the base and the intermediate portion of the lid. When the disclosed containers are stacked on top of one another, the channels form vent passages through which ventilated air and steam can escape into the gap space through the ventilation opening, and then from the gap space through the vent passages and outward way from the stack.

One general aspect of the present invention is a stackable container that includes a base comprising a bottom surrounded by a wall that extends upward from the bottom to an upper rim of the base, the wall being shaped such that the upper rim of the base extends horizontally beyond the bottom about its entire perimeter. The container further includes a lid having an outer region that is configured for direct attachment to the upper rim of the base, an intermediate region that extends upward from the outer region, the intermediate region being adjacent to and surrounded by the outer region, and an inner region that does not extend upward as far as the intermediate region, the inner region being adjacent to and surrounded by the intermediate region. When the container is an upper container that is stacked upon an identical lower container, the upper container is entirely supported by the intermediate region of the lower container, and a gap space is formed between the bottom of the base of the upper container and the inner region of the lid of the lower container.

In embodiments, at least one channel is formed in at least one of the wall of the base and the intermediate region of the lid, at least one ventilation opening is provided in the inner region of the lid, and the at least one channel forms at least one vent passage between the gap space and an environment outside of the stack, thereby providing ventilation to contents of the lower container through the at least one ventilation opening of the lower container into the gap space and out through the at least one vent passage. In some of these embodiments at least one of the channels is formed in the wall of the base. And in some of these embodiments, at least one of the channels is formed in the intermediate region of the lid.

In any of the above embodiments, the base of the container can be shaped as one of a round bowl, an oval bowl, and a polygon.

In any of the above embodiments, the intermediate region can include an apex ridge, and an outer portion of the intermediate region can be curved inward from an outer boundary of the intermediate region to the apex ridge.

In any of the above embodiments, when the container is an upper container that is stacked upon an identical lower container, the upper container can be supported entirely by an apex ridge of the intermediate region of the lower container. Or the intermediate region of the lid can include a concave inner surface, configured such that when the container is an upper container that is stacked upon an identical lower container, the upper container makes contact with substantially all of the concave inner surface of the lid of the lower container.

In any of the above embodiments, the bottom of the base can include a central raised portion, and/or the bottom of the base can extend downward from the wall of the base.

In any of the above embodiments, the central region of the lid can include a central upwardly projected portion or a central downwardly projected portion.

A second general aspect of the present invention is a set of containers comprising a first container according to any of the above embodiments, and a second container according to any of the above embodiments, the inner region of the lid of the second container being larger in diameter than the base of the first container, and at least one ventilation opening provided in the inner region of the lid of the second container proximate the intermediate region of the lid of the second container, said ventilation hole not being occluded by the base of the first container if the first container is stacked on top of the second container.

In embodiments, the bottom of the base of the first container extends downward from the wall of the base of the first container, and the central region of the lid of the second container includes a central downwardly projected portion, such that if the first container is stacked on top of the second container, the bottom of the base of the first container extends into a space formed in the lid of the second container by the downwardly projecting portion of the lid of the second container.

Or, the bottom of the base of the first container can include a central raised portion, and the central region of the lid of the second container includes a central upwardly projected portion, such that if the first container is stacked on top of the second container, the upwardly projected portion of the lid of the second container extends into a space formed in the bottom of the base of the first container by the central raised portion of the bottom of the first container.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

The present invention is a hot food container that is resistant to softening and sagging of the lid when in direct contact with the base of an adjacent stacked container that is filled with hot, heavy food. In embodiments, the container is stackable, ventilated, and spill-resistant.

Figure 1:
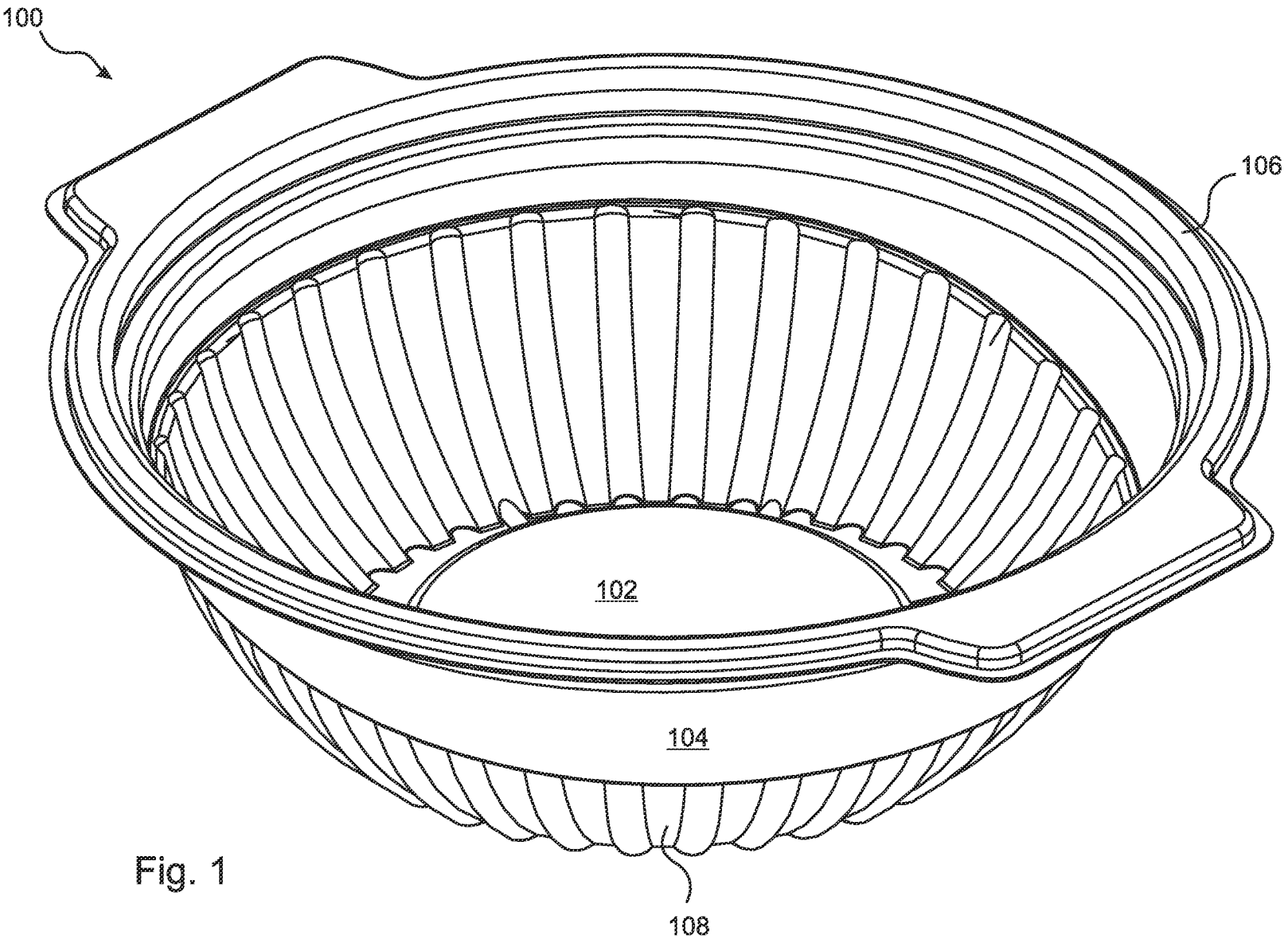
FIG. 1 is an upper perspective view drawn to scale of a container base having channels formed therein according to an embodiment of the present invention.
Figure 2:
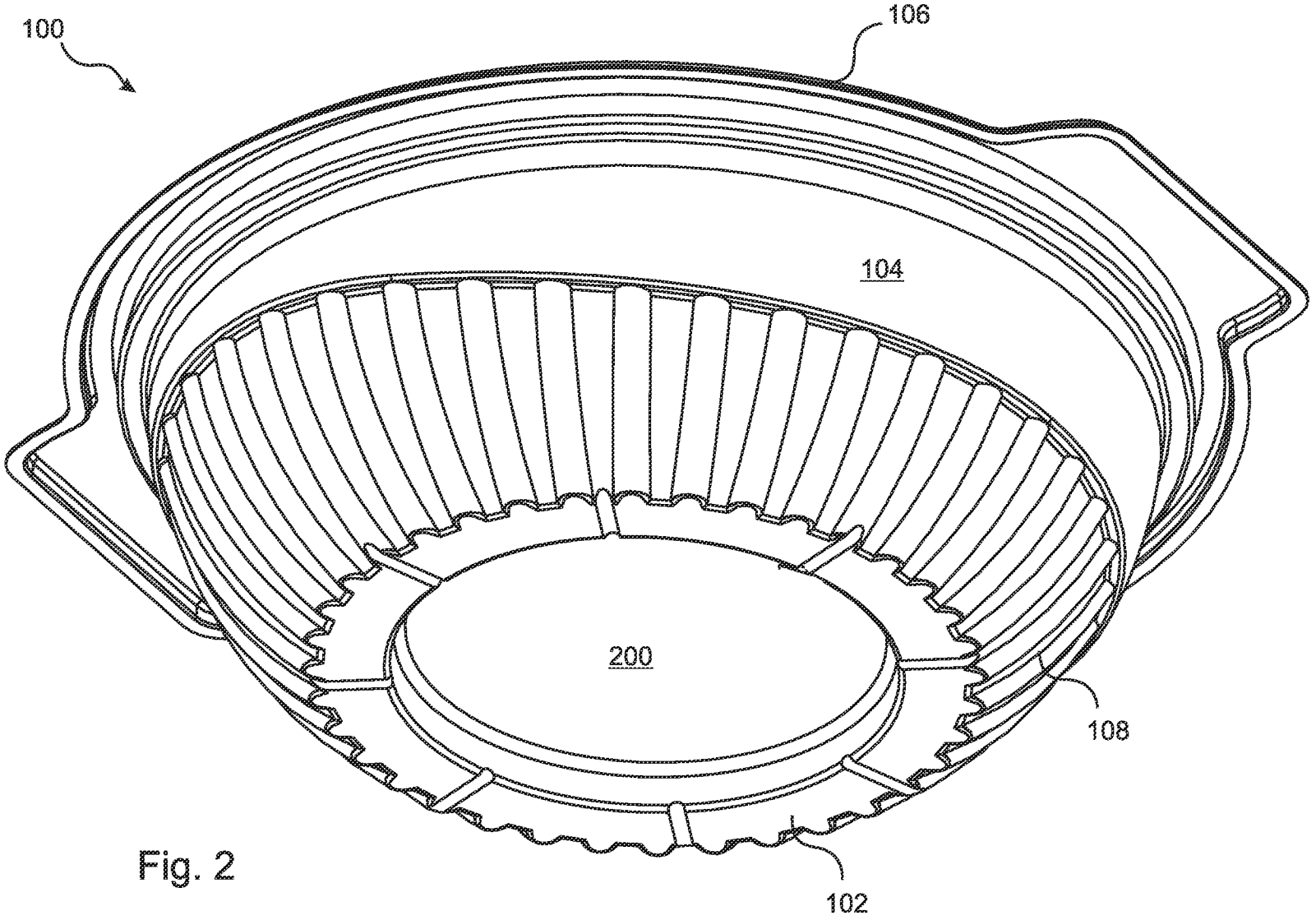
FIG. 2 is a lower perspective view drawn to scale of the container base of FIG. 1.

With reference to the upper perspective view of FIG. 1 and the lower perspective view of FIG. 2, the base 100 of the disclosed container includes a bottom 102 and at least one surrounding wall 104 arranged so that hot food contents placed within the container make direct contact only with the plastic of the base 100. An upper rim 106 of the base 100 is larger in diameter than the bottom 102, in that it extends horizontally outward beyond the base. In the illustrated embodiment, the surrounding wall 104 is curved outward, while in other embodiments the wall 104 is flat or takes on another shape. The bottom 102 in the illustrated embodiment further includes a raised central portion 200.

While the drawings herein depict a bowl-shaped base 100, it will be understood that in other embodiments the base 100 is rectangular, oval, star-shaped, polygon shaped, or any other desired shape, so long as the upper rim 106 consistently extends horizontally beyond the bottom 102, such that a hypothetical line projected directly downward from any point along the upper rim 106 will always fall outside of the bottom 102. It should be noted that in the specific embodiment of FIGS. 1 and 2, the wall 104 of the base 100 includes an upper flat region as well as a lower "ridged," "grooved," or fluted region. In other embodiments, the wall 104 of the base 100 is all of one shape, while in still other embodiments the wall 104 includes more than two regions with different shaping.

Figure 3:
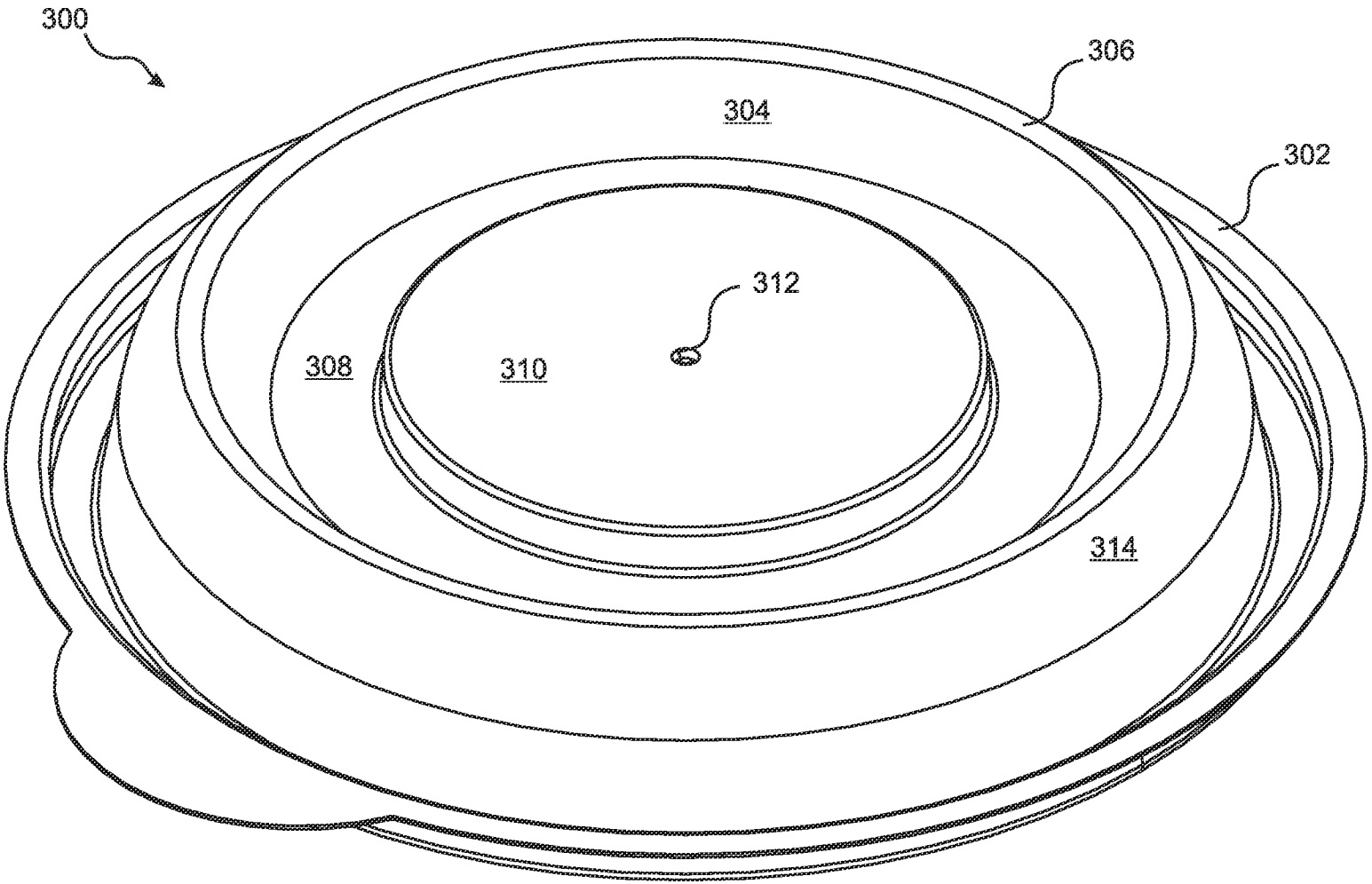
FIG. 3 is an upper perspective view drawn to scale of a lid compatible with the base of FIGS. 1 and 2, according to an embodiment of the present invention.
Figure 4:
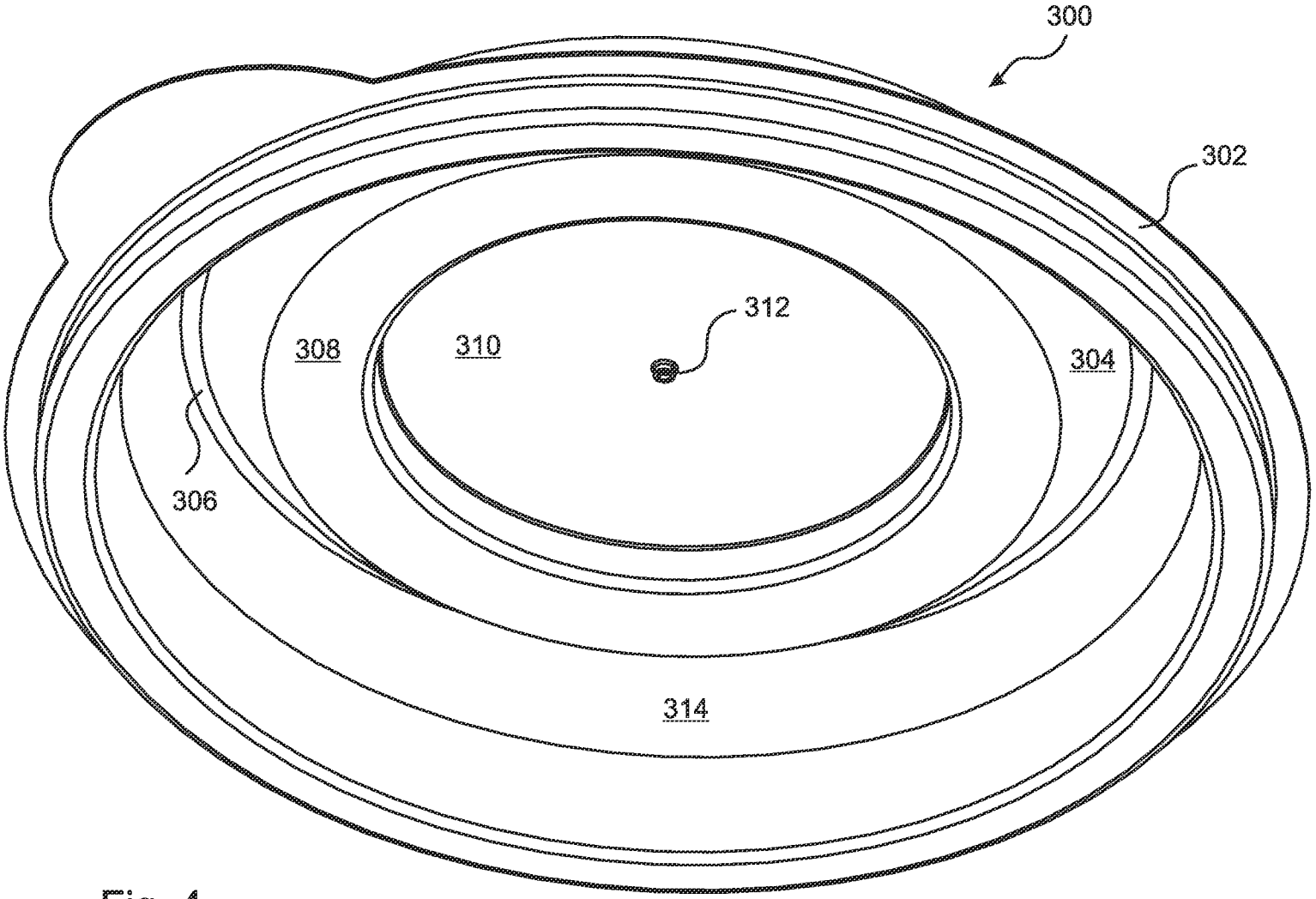
FIG. 4 is a lower perspective view drawn to scale of the container lid of FIG. 3.
Figure 5:
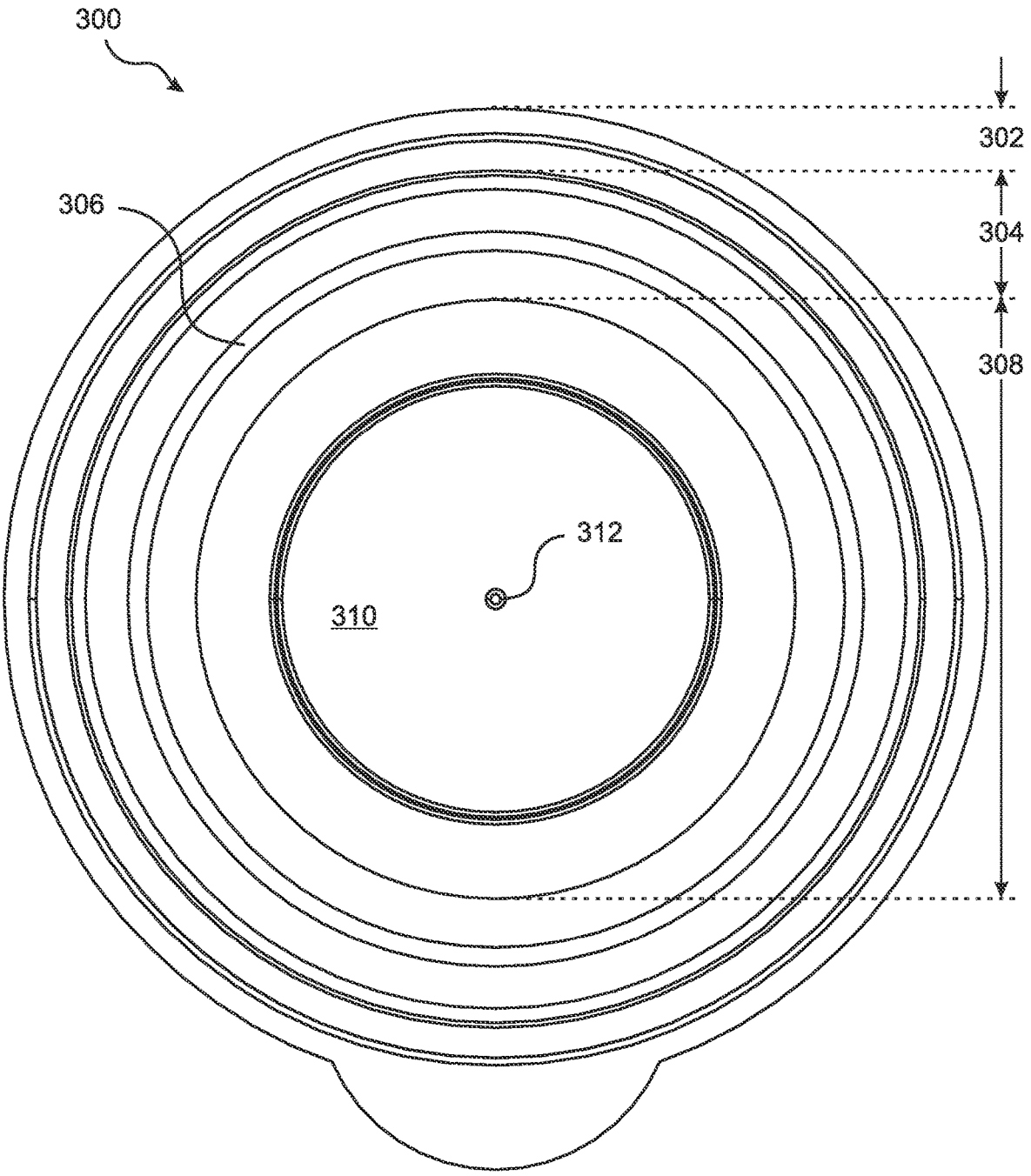
FIG. 5 is a top view drawn to scale of the lid of FIGS. 3 and 4.

With reference to the upper perspective view of FIG. 3, the lower perspective view of FIG. 4, and the top view of FIG. 5, the lid 300 of the disclosed container includes at least three concentric regions. An outer region or "rim" 302 of the lid 300 is configured for direct attachment to the upper rim 106 of the base 100. An intermediate region 304 of the lid 300 is raised above the outer region 302 and is configured to support the base 100 of an adjacent, stacked container.

In the embodiment of FIGS. 3-5, the intermediate region 304 rises to an apex ridge 306. An inner region 308 of the lid 300 does not rise as high as the intermediate region 304, and includes at least one ventilation opening 312. In the embodiment of FIGS. 3-5, the inner region 308 of the lid 300 includes a raised central portion 310 that does not rise as high as the apex ridge 306 of the intermediate region 304. Dashed lines are used in the top view of FIG. 5 to indicate the boundaries of the three concentric regions 302, 304, 308 in the embodiment of FIGS. 3-5.

Figure 6:
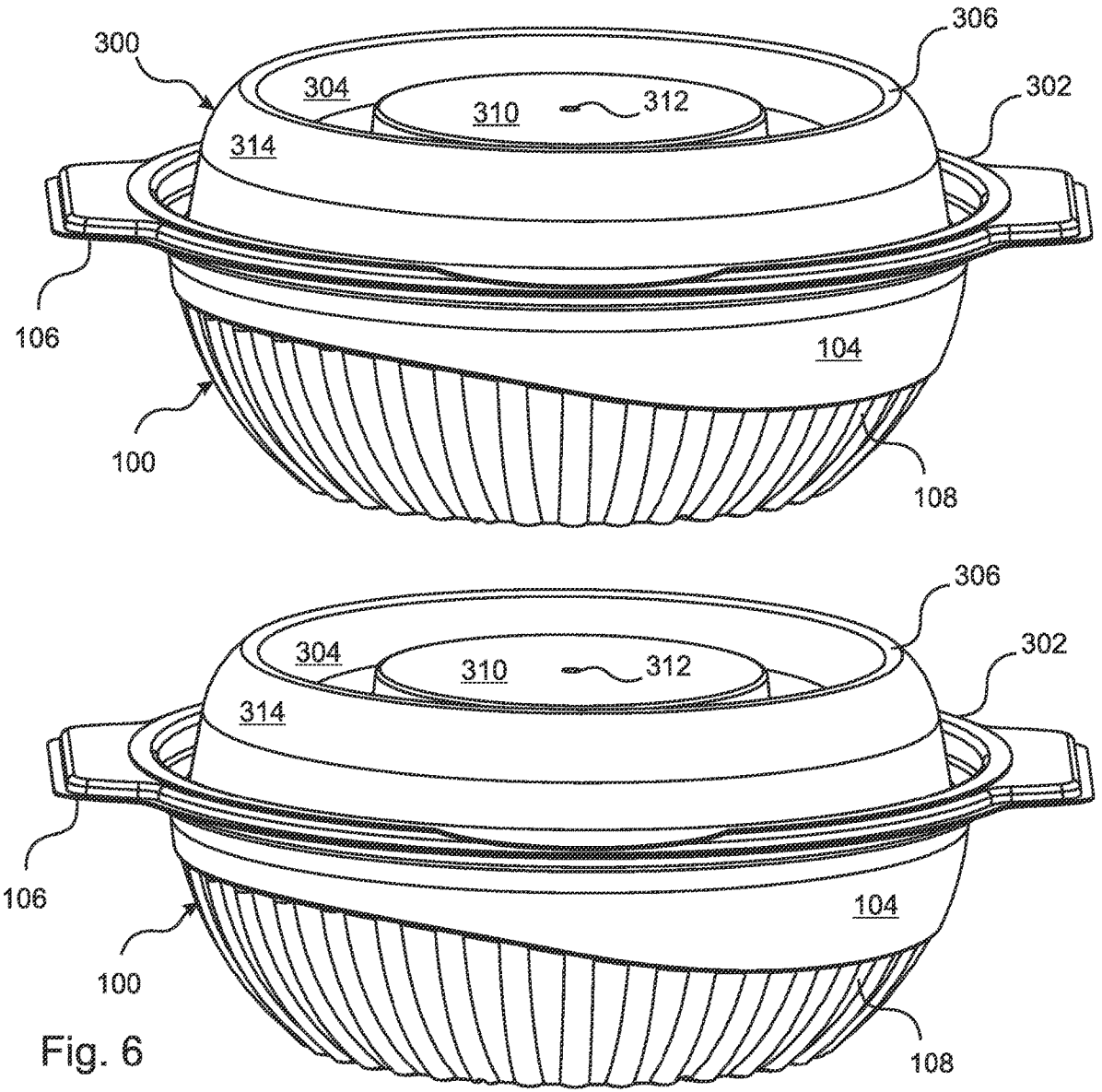
FIG. 6 is a side perspective view drawn to scale of the container of FIGS. 1 and 3 positioned above an identical container.
Figure 7:
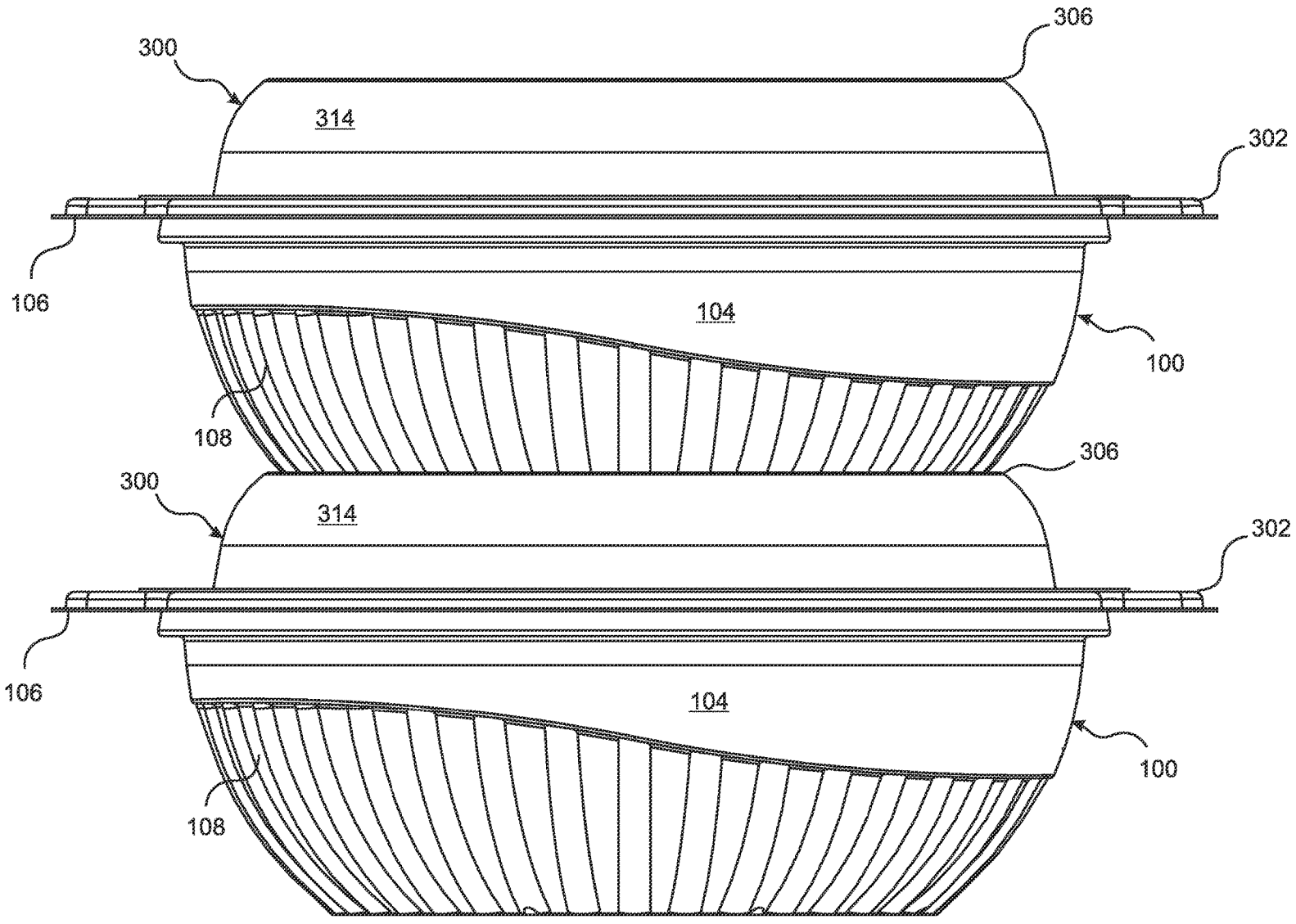
FIG. 7 is a side view drawn to scale of the containers of FIG. 6 arranged in a stack.
Figure 8:
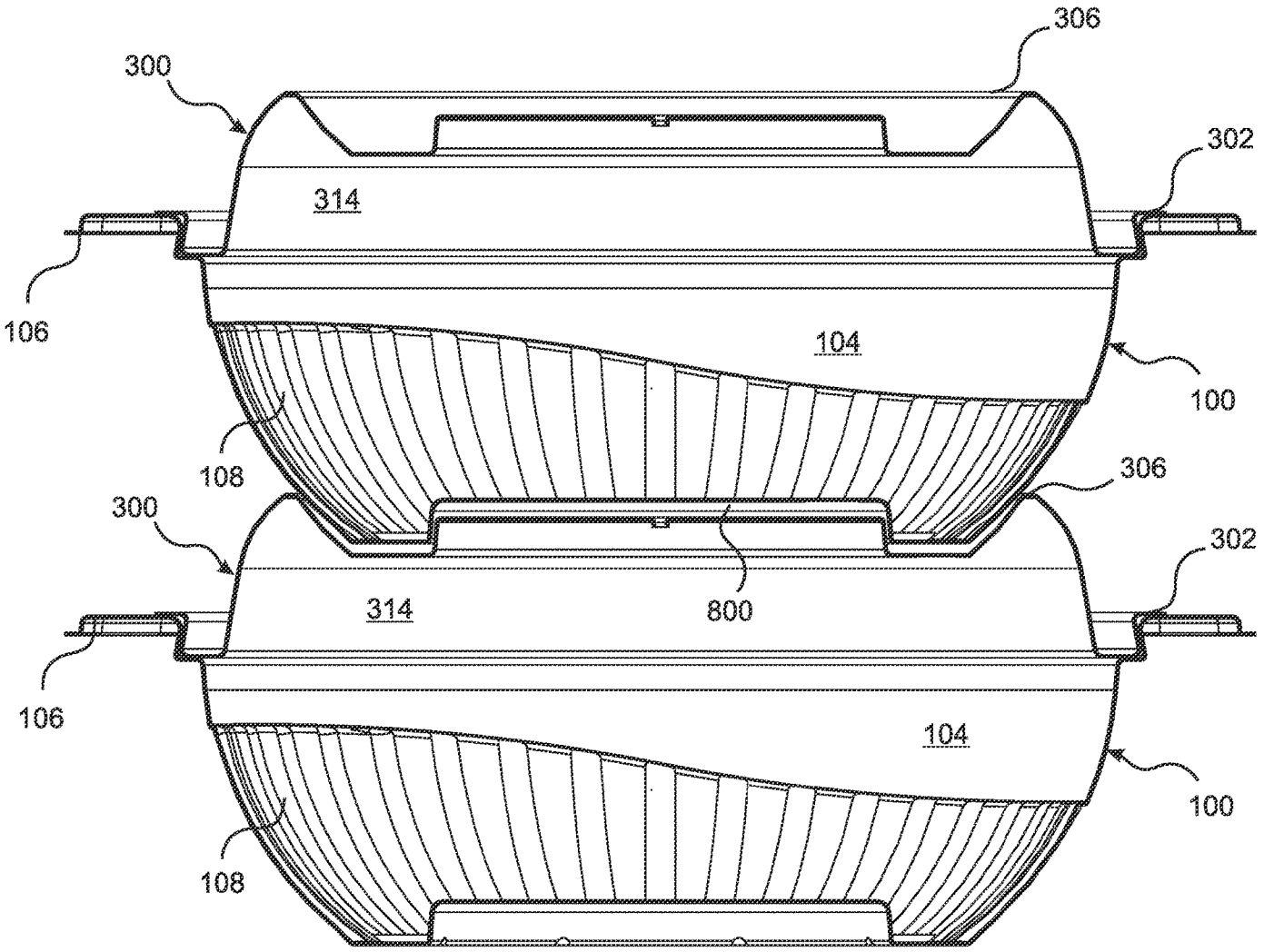
FIG. 8 is a sectional view drawn to scale of the stack of FIG. 7.

FIG. 6 is an upper perspective view of two identical containers of the embodiment of FIGS. 1-5 positioned one above the other. FIG. 7 is a side view showing the two containers of FIG. 6 stacked upon each other. FIG. 8 is a sectional view of the stacked containers of FIG. 7.

As can be seen in FIG. 8, when the containers are stacked the base 100 of the upper container is supported by the apex ridge 306 of the intermediate region 304 of the lower container. The shapes of the intermediate region 304 of the lid 300 and of the wall 104 of the base 100 are configured to create a gap space 800 between the base 100 of the upper stacked container and the inner region 308 (including the central region 304) of the lid 300 of the lower stacked container, which assures that the base 100 of the upper container will not directly block the ventilation opening or openings 312 of the lid 300 of the lower stacked container.

In the exemplary embodiment of FIGS. 1-8, channels 108 are formed in the wall 104 of the base 100 in the region that will contact the apex ridge 306 of the lid 300 of an adjacent lower container in a stack. In various other embodiments, the channels 108 are formed in the intermediate region 304 of the lid 300, or in both the wall 104 of the base 100 and the intermediate region 304 of the lid 300. When the disclosed containers are stacked on top of one another, these channels 108 create vent passages through which ventilated air and steam can escape from the gap space 800 through the vent passages and outward away from the stack.

Furthermore, because the base 100 of the upper container in a stack is supported entirely by the intermediate region 304 of the underlying lid 300, the only direct contact between the base and the lid is in the intermediate region 304 of the lid 300, and therefore proximal to the outer region 302 of the lid. This advantage over the prior art is also present in embodiments of the present invention that do not include a ventilation opening 312 or channels 108.

In the embodiment of FIGS. 7 and 8, the upper container rests almost entirely on the apex ridge 306 of the lid 300 of the lower container, so that only this very small portion 306 of the lid is subject to direct thermal contact with the upper container. The outer wall 314 of the intermediate region 304 in the illustrated embodiment is shaped somewhat like an arch, and is configured to convey the gravitational force applied by the upper container from the apex ridge 306 downward to the outer region 302 of the lid 300 as mainly a compressive force, rather than a bending force. As a result, deformation of the plastic of the lid 300 of the lower container by the upper container is minimized, even if the upper container is filled with a heavy, hot food item such as a hot soup, and the lid 300 of the lower container is made from a plastic that is thinner and/or more sensitive to heat than the plastic of the base 100.

Figure 9A:
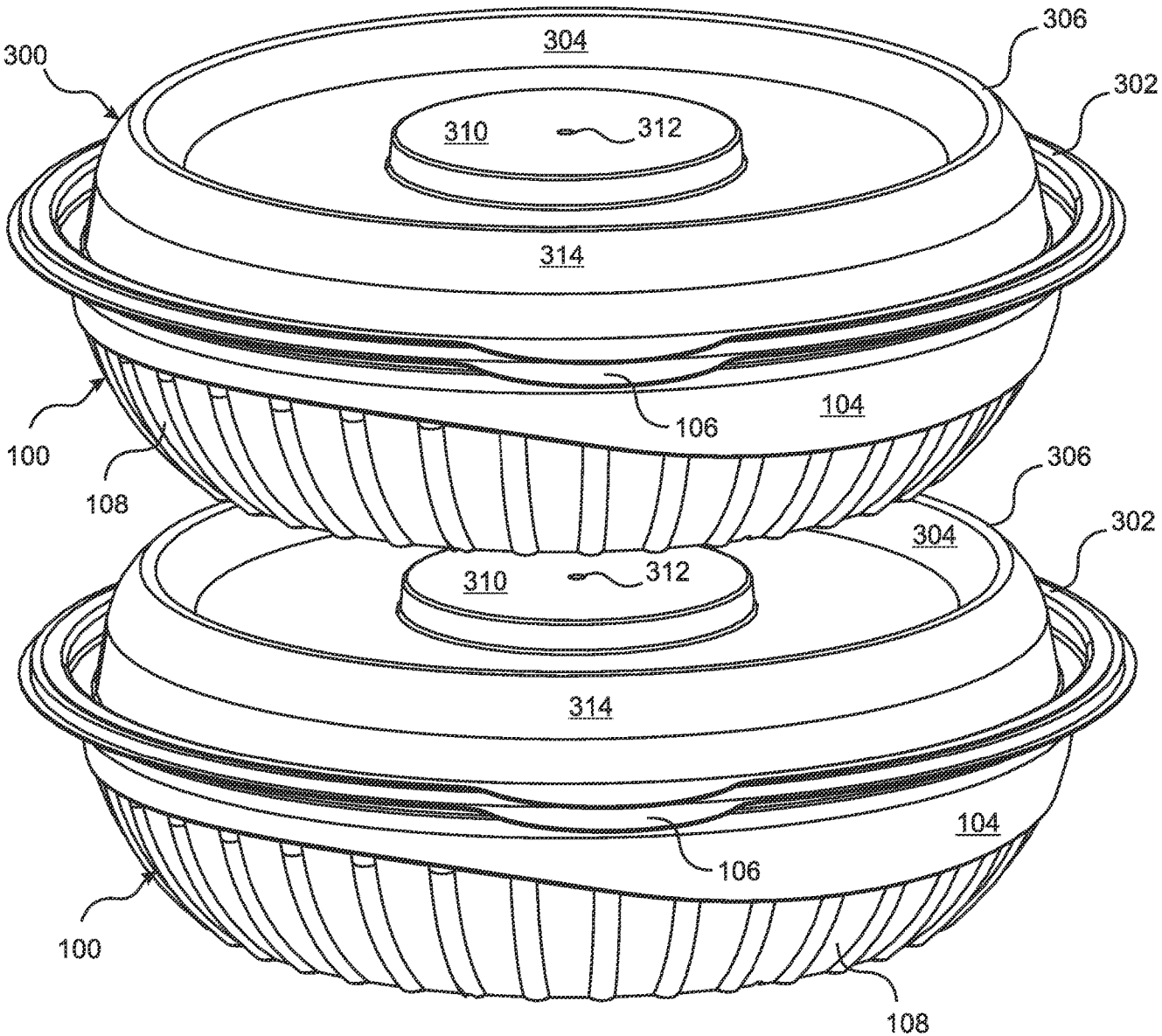
FIG. 9A is an upper perspective view drawn to scale of a pair of identical containers according to an embodiment of the present invention that are wider and shorter than the containers of FIG. 6.

FIG. 9A is a perspective view from above, similar to FIG. 6, that illustrates an embodiment of the present invention similar to the embodiment of FIGS. 1-8, but wider and shorter, so as to facilitate stacking of a plurality of compatible containers that are of similar shapes but have decreasing volumes while maintaining ventilation passages between each adjacent pair of containers in the stack.

Figure 9B:
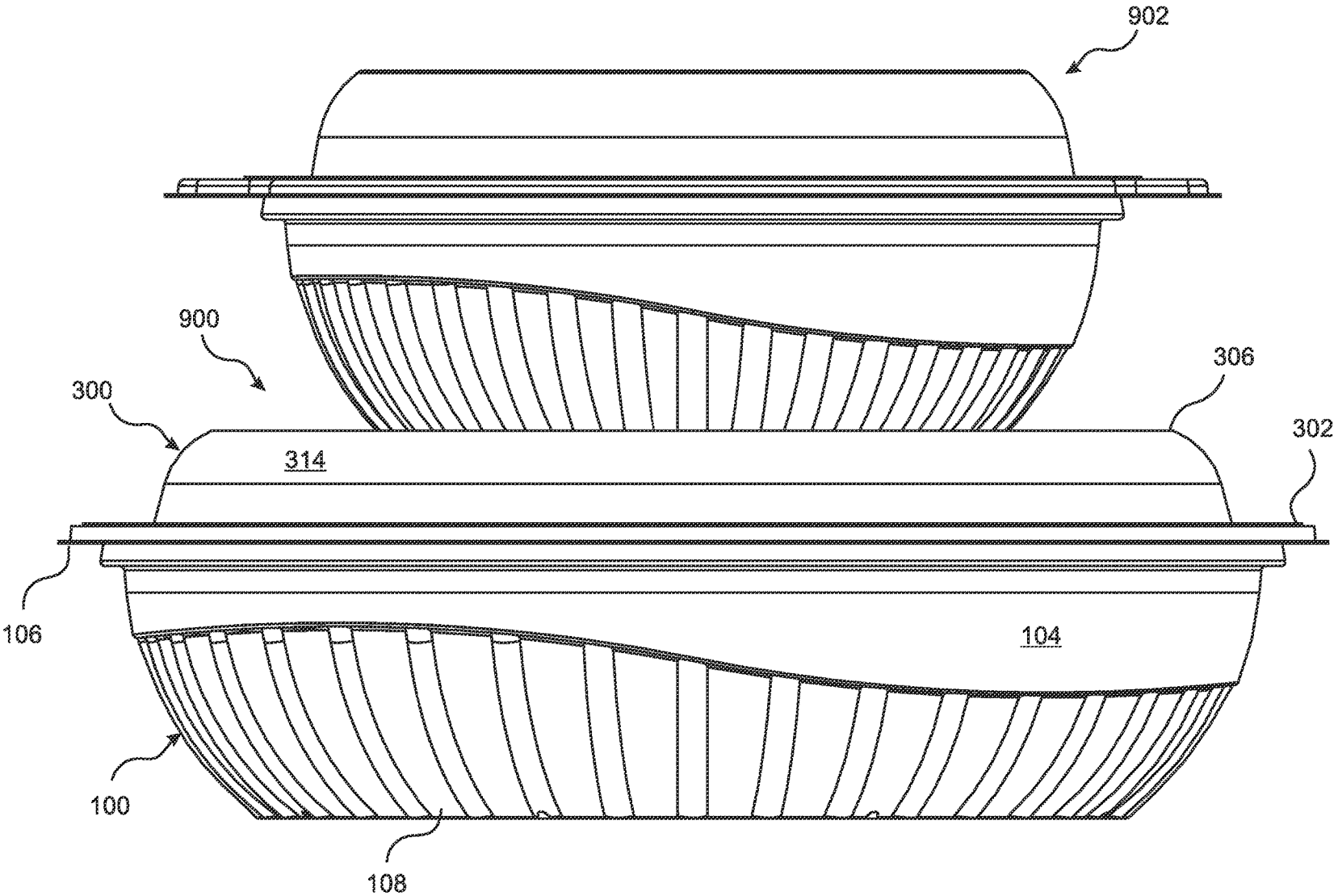
FIG. 9B is a side view drawn to scale of a container similar to FIG. 6 having a smaller container of a similar design stacked on top thereof.
Figure 9C:
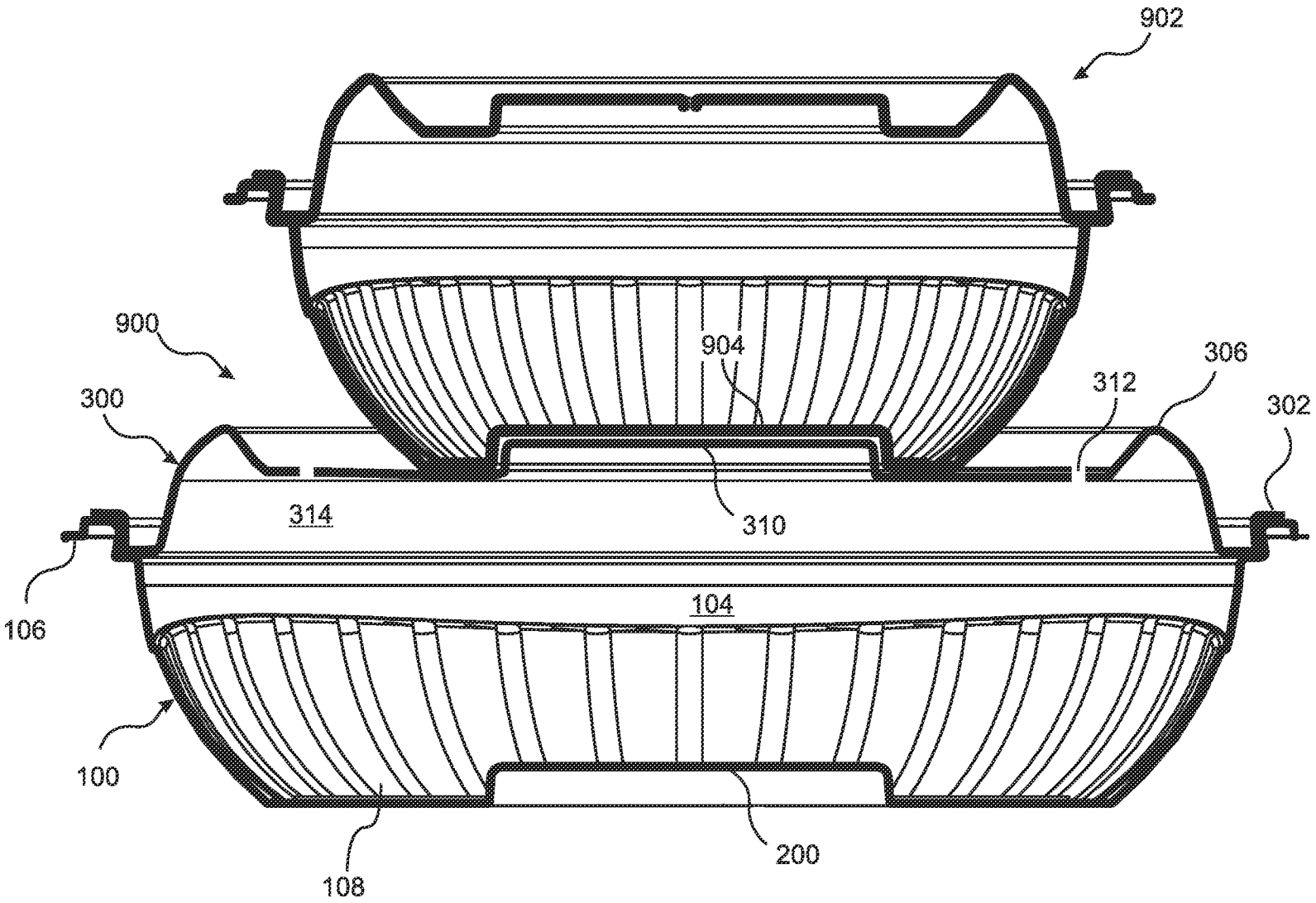
FIG. 9C is a sectional view drawn to scale of the stack of FIG. 9B

FIG. 9B is a side view of a container 900 similar to the container of FIGS. 1-8, with a smaller container 902 of a similar shape resting on top of it, and FIG. 9C is a sectional view of FIG. 9B. It can be seen in FIG. 9C that the bottom of the smaller container 902 includes a raised region 904 that is configured to nest about the raised portion 310 of the lid 306 of the larger container 900. Accordingly, while the smaller container 902 is not supported by the intermediate region 308 of the lid 300 of the larger container 900, it is nevertheless securely stacked on top of the lower container lid 300. In addition, the inner region 308 of the larger container 900 in the illustrated embodiment includes ventilation holes 312 near the boundary with the intermediate region 304 that are not blocked by the smaller container 902. Accordingly, if a plurality of both the larger 900 and smaller 902 container is available, then a plurality of either size of container can be stacked on top of each other with ventilation, or one or more of the smaller containers 902 can be stacked on top of one or more larger containers 900, with all of the containers in the stack being ventilated.

Figure 10:
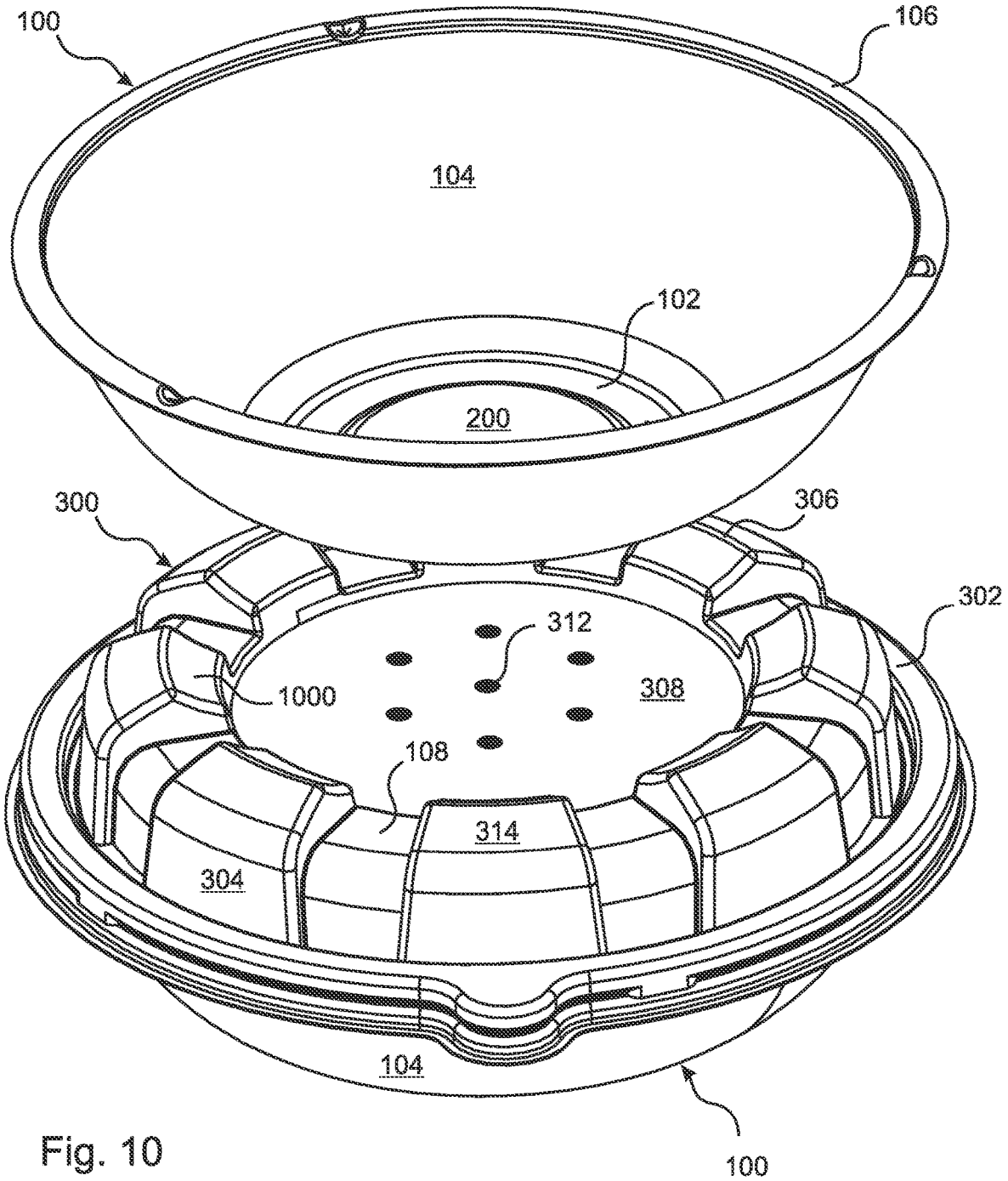
FIG. 10 is an upper perspective view drawn to scale of a container having channels formed in the intermediate region of its lid with an identical container base positioned above it.
Figure 11:
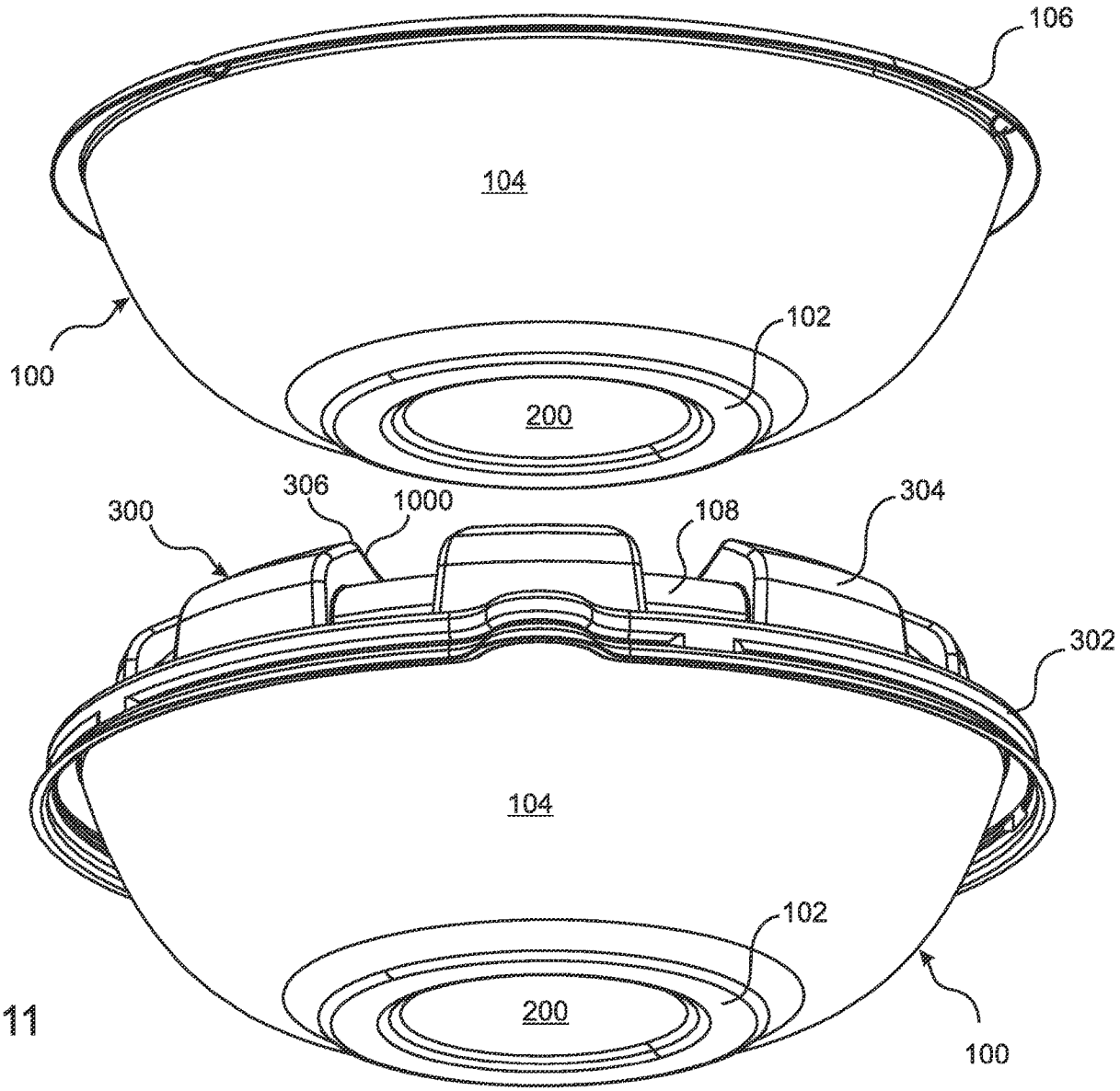
FIG. 11 is a lower perspective view drawn to scale of the container and identical base of FIG. 10.
Figure 12:
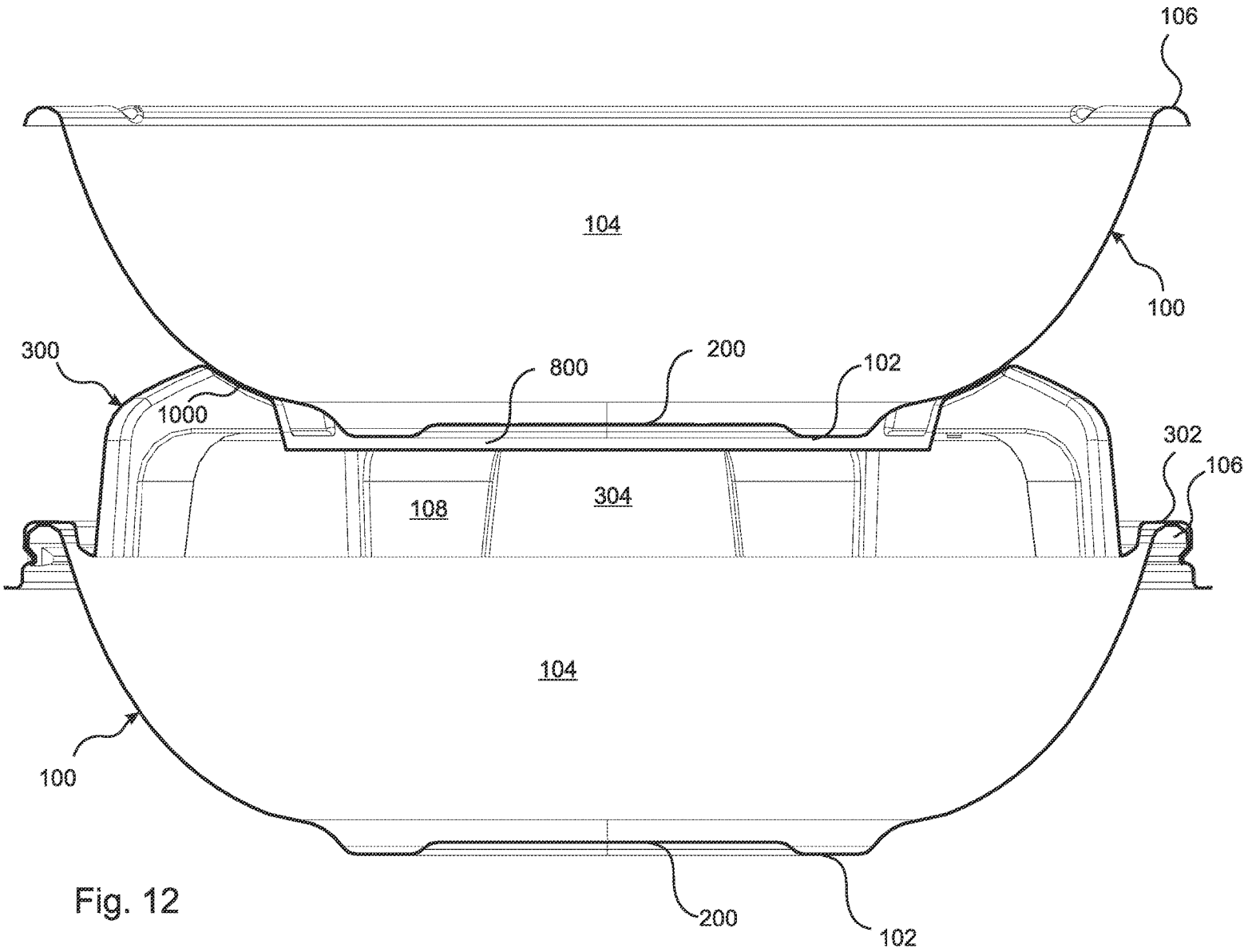
FIG. 12 is a sectional side view drawn to scale of the container of FIG. 10 with the identical base in a stacked configuration.

FIGS. 10-12 illustrate an embodiment of the present invention in which the channels 108 are provided in the intermediate region 304 of the lid, rather than in the wall 104 of the base 100. As noted above, in still other embodiments channels 108 are provided in both of the base 100 and the lid 300. For the container of FIGS. 10-12, the wall 104 of the base 100 is smooth and is not divided into multiple regions, and the inner region 308 of the lid 300 is flat, and does not include a raised central region 310. A plurality of vent openings 312 are provided in the inner region 308 of the lid 300.

With reference to the perspective view from above of FIG. 10, the intermediate region 304 of the lid 300 includes a concave portion 1000 that extends from the apex ridge 306 to the boundary with the inner region 308. With reference to the sectional view of FIG. 12, the concave portion 1000 is shaped so as to complement the curved shape of the wall 104 of the base 100, so that the base 100 of the upper container makes contact over substantially the entire concave portion 1000 of the lid 300 of the lower container, thereby providing stable support to the base 100 of the adjacent upper container in the stack.

With reference to FIGS. 11 and 12, in this embodiment the bottom 102 of the base 100 extends downward from the wall 104 of the base 100, and is configured to descend below the concave portion 1000 toward the central region 304 of the underlying lid 300 in the stack, thereby providing additional stability to the stack. The gap space is maintained, because the downward extending bottom 102 of the base 100 does not descend far enough to make contact with the inner region 308 of the lid 300, and the vent passages that are formed by the channels 108 that are provided in the intermediate region 304 of the lid 300 ensure that vented hot air and steam are able to escape from the gap space 800.

It will be understood that in embodiments the advantages of the present invention are maintained whenever the container is a first container included in a stack with a second container that is compatible with the first container. As used herein, the term "compatible containers" refers to containers that, when stacked in at least one order, provide ventilation of all containers in the stack that are described herein.

The foregoing description of the embodiments of the invention has been presented for the purposes of illustration and description. Each and every page of this submission, and all contents thereon, however characterized, identified, or numbered, is considered a substantive part of this application for all purposes, irrespective of form or placement within the application. This specification is not intended to be exhaustive or to limit the invention to the precise form disclosed. Many modifications and variations are possible in light of this disclosure.

Although the present application is shown in a limited number of forms, the scope of the invention is not limited to just these forms, but is amenable to various changes and modifications. The disclosure presented herein does not explicitly disclose all possible combinations of features that fall within the scope of the invention. The features disclosed herein for the various embodiments can generally be interchanged and combined into any combinations that are not self-contradictory without departing from the scope of the invention. In particular, the limitations presented in dependent claims below can be combined with their corresponding independent claims in any number and in any order without departing from the scope of this disclosure, unless the dependent claims are logically incompatible with each other.

I claim:

1. A stackable container comprising:

a base comprising a bottom surrounded by a wall that extends upward from the bottom to an upper rim of the base, the wall being shaped such that the upper rim of the base extends horizontally beyond the bottom about its entire perimeter;

a lid comprising:

an outer region that is configured for direct attachment to the upper rim of the base;

an intermediate region that extends upward from the outer region, the intermediate region being adjacent to and surrounded by the outer region; and an inner region that does not extend upward as far as the intermediate region, the inner region being adjacent to and surrounded by the intermediate region;

wherein, when the container is an upper container that is stacked upon an identical lower container:

the upper container is entirely supported by the intermediate region of the lower container;

a gap space is formed between the bottom of the base of the upper container and the inner region of the lid of the lower container; and wherein a central region of the lid includes a central upwardly projected portion or a central downwardly projected portion;

wherein the upper container is supported entirely by an apex ridge of the intermediate region of the lower container.

2. The container of claim 1, wherein:

at least one channel is formed in at least one of the wall of the base and the intermediate region of the lid;

at least one ventilation opening is provided in the inner region of the lid; and the at least one channel forms at least one vent passage between the gap space and an environment outside of the stack, thereby providing ventilation to contents of the lower container through the at least one ventilation opening of the lower container into the gap space and out through the at least one vent passage.

3. The container of claim 2, wherein the at least one channel is formed in the wall of the base.

4. The container of claim 3, wherein the at least one channel is formed in the intermediate region of the lid.

5. The container of claim 2, wherein the at least one channel is formed in the intermediate region of the lid.

6. The container of claim 1, wherein the base of the container is shaped as one of:

a round bowl;

an oval bowl; and a polygon.

7. The container of claim 1, wherein the intermediate region includes an apex ridge, and wherein an outer portion of the intermediate region is curved inward from an outer boundary of the intermediate region to the apex ridge.

8. The container of claim 1, wherein the intermediate region of the lid includes a concave inner surface, and wherein when the container is an upper container that is stacked upon an identical lower container, the upper container makes contact with the concave inner surface of the lid of the lower container.

9. The container of claim 1, wherein the bottom of the base includes a central raised portion.

10. The container of claim 1, wherein the bottom of the base extends downward from the wall of the base.

11. A set of containers comprising:

a first container according to any preceding claim;

a second container according to any preceding claim, the inner region of the lid of the second container being larger in diameter than the base of the first container;

a central region of the lid of the second container includes a central downwardly or upwardly projected portion; and at least one ventilation opening provided in the inner region of the lid of the second container proximate the intermediate region of the lid of the second container, said ventilation hole not being occluded by the base of the first container if the first container is stacked on top of the second container.

12. The container set of claim 11, wherein:

the bottom of the base of the first container extends downward from the wall of the base of the first container;

the central region of the lid of the second container includes the central downwardly projected portion; and the first container is stacked on top of the second container, the bottom of the base of the first container extends into a space formed in the lid of the second container by the downwardly projecting portion of the lid of the second container.

13. The container set of claim 11, wherein:

the bottom of the base of the first container includes a central raised portion;

the central region of the lid of the second container includes the central upwardly projected portion; and the first container is stacked on top of the second container, the upwardly projected portion of the lid of the second container extends into a space formed in the bottom of the base of the first container by the central raised portion of the bottom of the first container.

* * * * *